US005481341A

United States Patent [19]

Sypula et al.

[11] Patent Number: 5,481,341

[45] Date of Patent: Jan. 2, 1996

[54] ROLLER FOR CONTROLLING APPLICATION OF CARRIER LIQUID

[75] Inventors: Donald S. Sypula, Penfield; Santokh S. Badesha, Pittsford; Shu Chang, Webster; John F. Knapp, Fairport; Robert E. Trott, Webster, all of N.Y.; Stephen T. Chai, Rancho Palo Verdes, Calif.; Henry R. Till, East Rochester; Joseph Mammino, Penfield, both of N.Y.

[73] Assignee: Xerox Corporation, Stamford, Conn.

[21] Appl. No.: 107,876

[22] Filed: Aug. 18, 1993

[51] Int. Cl.[6] ..... G03G 15/10

[52] U.S. Cl. ..... 355/256; 118/661; 355/246

[58] Field of Search ..... 355/245, 246, 355/253, 255, 256, 257, 258, 259, 307, 306; 118/651, 652, 653, 654, 655, 656, 659, 660, 661, 662

[56] References Cited

U.S. PATENT DOCUMENTS

| | | | |
|---|---|---|---|
| 3,866,572 | 2/1975 | Gundlach . | |
| 4,089,683 | 5/1978 | Knieser . | |
| 4,183,658 | 1/1980 | Winthaegen . | |
| 4,258,115 | 3/1981 | Magome et al. . | |
| 4,263,391 | 4/1981 | Saito et al. . | |
| 4,327,664 | 5/1982 | Ohkawa et al. . | |
| 4,684,238 | 8/1987 | Till et al. . | |
| 4,690,539 | 9/1987 | Radulski et al. . | |
| 4,707,112 | 11/1987 | Hartmann . | |
| 5,119,140 | 6/1992 | Berkes et al. . | |
| 5,167,987 | 12/1992 | Yu . | |
| 5,241,343 | 8/1993 | Nishio | 355/259 X |

FOREIGN PATENT DOCUMENTS

| | | | |
|---|---|---|---|
| 0061062 | 9/1982 | European Pat. Off. . | |
| 0156046 | 10/1985 | European Pat. Off. . | |
| 2935264 | 3/1980 | Germany . | |
| 2935270 | 3/1980 | Germany . | |
| 52-40336 | 3/1977 | Japan | 355/259 |
| 53-111739 | 9/1978 | Japan | 355/259 |
| 54-56846 | 5/1979 | Japan | 355/259 |
| 55-33160 | 3/1980 | Japan | 355/259 |
| 4-285979 | 10/1992 | Japan | 355/259 |
| 4-333080 | 11/1992 | Japan | 355/256 |
| 5-35118 | 2/1993 | Japan | 355/256 |
| 2041790 | 9/1980 | United Kingdom | 355/259 |

*Primary Examiner*—A. T. Grimley
*Assistant Examiner*—Shuk Y. Lee
*Attorney, Agent, or Firm*—Oliff & Berridge; Eugene O. Palazzo

[57] ABSTRACT

A roller for controlling the application of carrier liquid to an image bearing member in an electrostatographic reproduction apparatus having a rigid porous electroconductive supportive core, a conformable microporous covering provided around the core, and a pressure controller. The pressure controller is located to provide a positive or negative pressure within the porous core and across a cross section of the core and covering.

51 Claims, 3 Drawing Sheets

ROLLER FOR CONTROLLING APPLICATION OF CARRIER LIQUID

BACKGROUND OF THE INVENTION

This invention relates to an electrostatographic printing machine, and more particularly to an apparatus for developing a latent image recorded on an imaging surface with a liquid developer.

A typical electrostatographic printing machine employs a photoconductive member that is sensitized by charging to a substantially uniform potential. The charged portion of the photoconductive member is exposed to the light image of a document. Exposure of the charged photoconductive member selectively dissipates the charge to record an electrostatic latent image. The electrostatic latent image corresponds to the informational areas of the document. The electrostatic latent image recorded on the photoconductive member is developed by contact with a developer material. The developer material can be a dry material comprising carrier granules having adhering toner particles. The latent image attracts the toner particles from the carrier granules to form a toner powder image on the photoconductive surface. The toner powder image is then transferred and permanently fused to a copy sheet.

An electrostatic latent image also may be developed with a liquid developer material. In a liquid development system, the photoconductive surface is contacted with an insulating liquid carrier having dispersed finely divided marking particles. The electrical field associated with the electrostatic latent image attracts the marking particles to the photoconductive surface to form a visible image.

Liquid developing imaging processes utilize a liquid developer typically having about 2 percent by weight of fine solid particulate toner material dispersed in a liquid carrier. The liquid carrier is typically a hydrocarbon. In the developing process, the image is transferred to a receiver which may be an intermediate belt. The image on the photoreceptor contains about 12 weight percent of particulate toner in liquid hydrocarbon carrier. To improve the quality of transfer of developed image to receiver, percent solids in liquid should be increased to about 25 percent by weight. Increase in percent solids may be achieved by removing excess hydrocarbon liquid. However, excess hydrocarbon liquid must be removed in a manner that results in minimum degradation of the toner image.

U.S. Pat. No. 3,866,572, to Gundlach, Feb. 18, 1975, relates to an electrostatographic apparatus wherein a transfer bias voltage is applied between a roller electrode and a first support surface to provide an electrical field for transfer between roller and surface. The roller electrode comprises an electrically conductive core. The bias voltage is applied to the core spaced from the first support surface. A thick highly compressible roller body of foraminous open cell material extends between the conductive core and the first support surface. The foraminous material has a multiplicity of small discontinuities providing an ionization control barrier. The foraminous material may be compressed between the conductive core and the first support surface to a thickness approximately one-half of its normal uncompressed thickness.

U.S. Pat. No. 4,089,683, to Knieser, May 16, 1978, relates to an apparatus for eliminating transfer of residual liquid developer from an imaging surface. The imaging surface is contacted with an advancing, transversely-oriented foam belt. The belt has a pattern of raised and depressed areas to redistribute streaks and deposits of liquid developer remaining on the imaging surface.

U.S. Pat. No. 4,258,115, to Magome et al., Mar. 24, 1981, discloses a device for wet developing an electrostatic image comprising a bearing member for forming a pool of developing liquid and a developing member for supplying developing liquid and collecting excess liquid. The developing member is an elastic member formed into a roller.

U.S. Pat. No. 4,263,391, to Saito et al., Apr. 21, 1981, discloses an elastic rotary member with an electroconductive core member, an electroconductive porous elastic member capable of retaining a liquid and provided around the core member and a liquid-permeable insulating member surrounding the outer periphery of the elastic member. The elastic rotary member is maintained in pressure contact with the latent image carrying member whereby liquid developer is squeezed out from the elastic rotary member and excessive liquid developer present on the latent image carrying member is recovered by absorption upon recovery of the elastic rotary member from a compressed state.

U.S. Pat. No. 4,707,112, to Hartmann, Nov. 17, 1987, relates to an apparatus for developing an electrostatic latent image. The apparatus includes means for furnishing liquid developer material to the image in a development zone and means for dispersing the particles substantially uniformly in the liquid carrier of the liquid developer material at the entrance to the development zone so as to deflocculate marking particles. The dispersing means may comprise means for generating a pulsed electrical field in the developer material at the entrance to the development zone to induce movement of the marking particles and the liquid carrier. The generating means includes an electrode positioned at the entrance to the development zone and means for applying a pulsed voltage to the electrode to generate a pulsed electrical field in the developer material.

The present invention provides an improved apparatus for application of carrier liquid to a photoreceptor and an improved electrostatographic imaging process.

Summary of the Invention

The present invention relates to an electrostatographic reproduction apparatus with a porous roller for controlling application of carrier liquid to an image bearing member. The roller provides improved application of toner and improved removal of excess carrier liquid. The roller comprises a rigid porous electroconductive supportive core, a conformable microporous covering provided around the core and a pressure controller located to provide a positive or negative pressure within the porous core and across a cross-section of the core and covering.

Additionally, the invention relates to an electrostatographic reproduction apparatus comprising an image bearing member and the roller for controlling application of carrier liquid.

Finally, the invention provides an electrostatographic process. The process includes the steps of forming a latent electrostatic image on a moving imaging surface, developing the latent image with liquid developer and removing excess liquid from said imaging surface. The removing step is effectuated by contacting the imaging surface with the roller having a rigid porous electroconductive supportive core, a conformable microporous covering provided around the core and a pressure controller located to provide a positive or negative pressure within the porous core and across a cross-section of the core and its covering. The application of liquid toner is controlled and excess carrier liquid removed from the imaging surface by applying a pressure gradient from within the core of the roller.

BRIEF DESCRIPTION OF THE PREFERRED EMBODIMENTS

Figure 1:
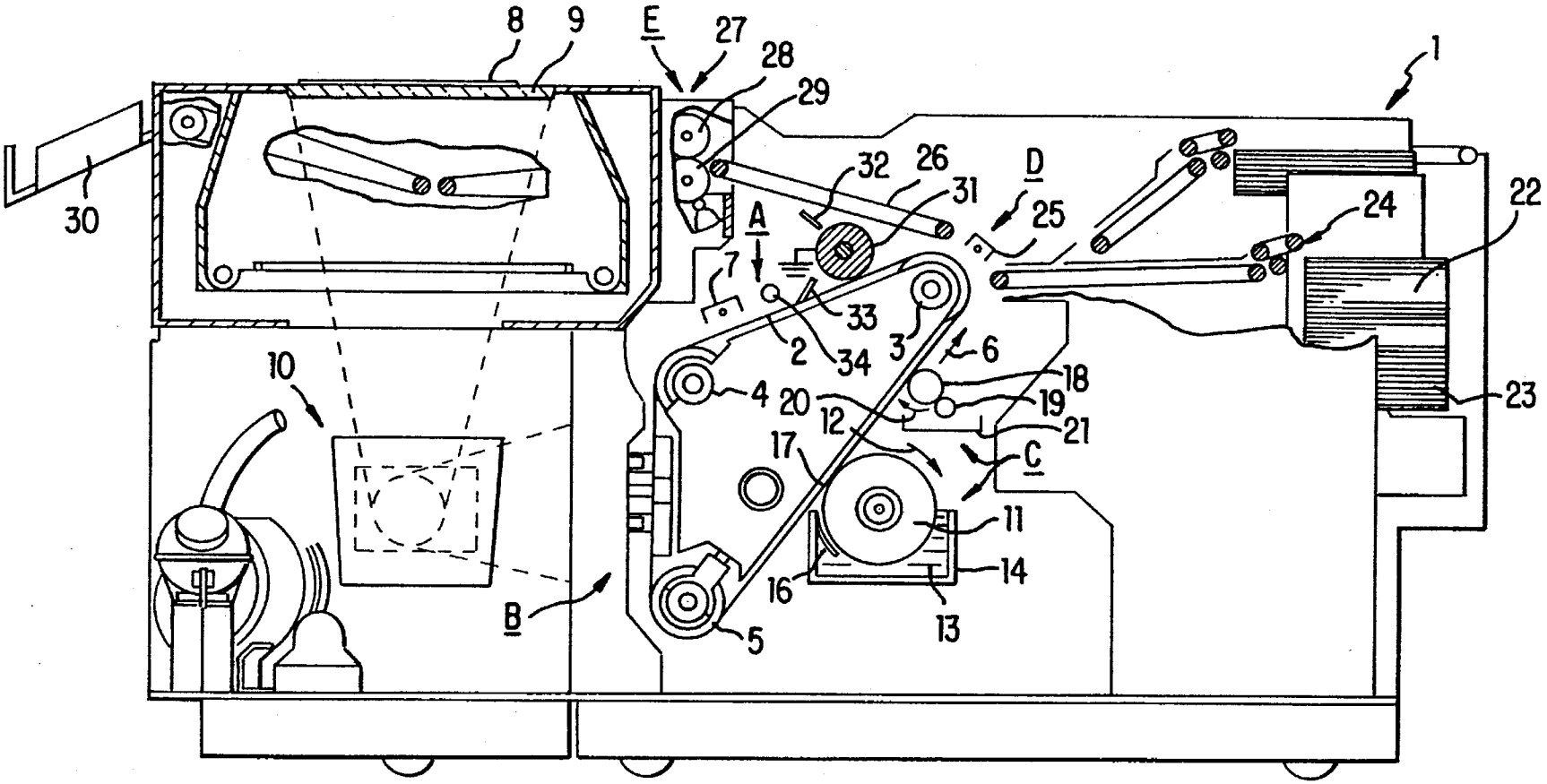
FIG. 1 is a schematic elevational view depicting an electrostatographic printing machine incorporating the features of the present invention.

In FIG. 1, printing machine 1 employs belt 2 having a photoconductive surface deposited on a conductive substrate. Typically, the photoconductive surface is made from a selenium alloy with the conductive substrate being an aluminum alloy which is electrically grounded. Belt 2 advances successive portions of the photoconductive surface sequentially through the various processing stations disposed about the path of movement. The support assembly for belt 2 includes three rollers 3, 4 and 5 located with parallel axes approximately at the apexes of a triangle. Roller 3 is rotatably driven by a suitable motor and a drive (not shown) so as to rotate and advance belt 2 in the direction of arrow 6.

Initially, belt 2 passes through charging station A. At charging station A, a corona generating device 7 charges the photoconductive surface of belt 2 to a relatively high, substantially uniform potential.

After the photoconductive surface of belt 2 is charged, the charged portion is advanced to exposure station B. At exposure station B, an original document 8 is placed upon a transparent support platen 9. An illumination assembly, indicated generally by the reference numeral 10, illuminates the original document 8 on platen 9 to produced image rays corresponding to the document information areas. The image rays are projected by means of an optical system onto the charged portion of the photoconductive surface. The light image dissipates the charge in selected areas to record an electrostatic latent image on the photoconductive surface corresponding to the original document informational areas.

After the electrostatic latent image has been recorded, belt 2 advances the electrostatic latent image to development station C. At development station C, roller 11, rotating in the direction of arrow 12, advances a liquid developer material 13 from the chamber of housing 14 to development zone 15. An electrode 16 positioned before the entrance to development zone 17 is electrically biased to generate an AC field just prior to the entrance to development zone 15 so as to disperse the marking particles substantially uniformly throughout the liquid carrier. The marking particles, disseminated through the liquid carrier, pass by electrophoresis to the electrostatic latent image. The charge of the marking particles is opposite in polarity to the charge on the photoconductive surface.

By way of example, the insulating carrier liquid may be a hydrocarbon liquid although other insulating liquids may also be employed. A suitable hydrocarbon liquid is an Isopar which is a trademark of the Exxon Corporation. These are branched chained aliphatic hydrocarbon liquids (largely decane). The toner particles comprise a binder and a pigment. The pigment may be carbon black. However, one skilled in the art will appreciate that any suitable liquid development material may be employed.

Development station C includes porous roller 18. Roller 18 receives the developed image on belt 2 and reduces fluid content on the image to provide an increase in percent solids. The increase in percent solids improves quality of the developed image. Porous roller 18 will be described hereinafter in detail with reference to FIGS. 2, 3 and 4. Porous roller 18 operates in conjunction with cleaner roller 19. Cleaning roller 19 is biased against the surface of porous roller 18. The cleaning roller 19 consists of a porous plastic, and is driven in a direction opposite to the rotational direction of porous roller 18.

In operation, roller 18 rotates in direction 20 to imposed against the "wet" image on belt 2. The porous body of roller 18 absorbs excess liquid from the surface of the image. The liquid-containing portion of porous roller 18 continues to rotate in direction 20 into contact with cleaning roller 19. Cleaning roller 19 presses against porous roller 18 and squeezes excess liquid from the roller 18 into liquid receptacle 21. Porous roller 18, discharged of excess liquid, continues to rotate in direction 20 to provide a continuous absorption of liquid from image on belt 2.

After the electrostatic latent image is developed, belt 2 advances the developed image to transfer station D. At transfer station D, a sheet of support material 22 is advanced from stack 23 by a sheet transport mechanism, indicated generally by the reference numeral 24. Transfer station D includes a corona generating device 25 which sprays ions onto the backside of the sheet of support material 22. This attracts the developed image from the photoconductive surface of belt 2 to copy sheet 22. After transfer, conveyor belt 26 moves the copy sheet 22 to fusing station E.

Fusing station E includes a fuser assembly indicated generally by the reference numeral 27, which permanently fuses the developed image to the copy sheet 22. Fuser assembly 27 includes a heated fuser roll 28 and back-up pressure roll 29 resiliently urged into engagement with one another to form a nip through which the copy sheet 22 passes. After fusing, the finished copy sheet 22 is discharged to output tray 30 for removal by the machine operator.

After the developed image is transferred to copy sheet 22, residual liquid developer material remains adhering to the photoconductive surface of belt 2. A cleaning roller 31 formed of any appropriate synthetic resin, is driven in a direction opposite to the direction of movement of belt 2 to scrub the photoconductive surface clean. To assist in this action, developing liquid may be fed through pipe 32 to the surface of cleaning roller 31. A wiper blade 33 completes the cleaning of the photoconductive surface. Any residual charge left on the photoconductive surface is extinguished by flooding the photoconductive surface with light from lamps 34.

Figure 2:
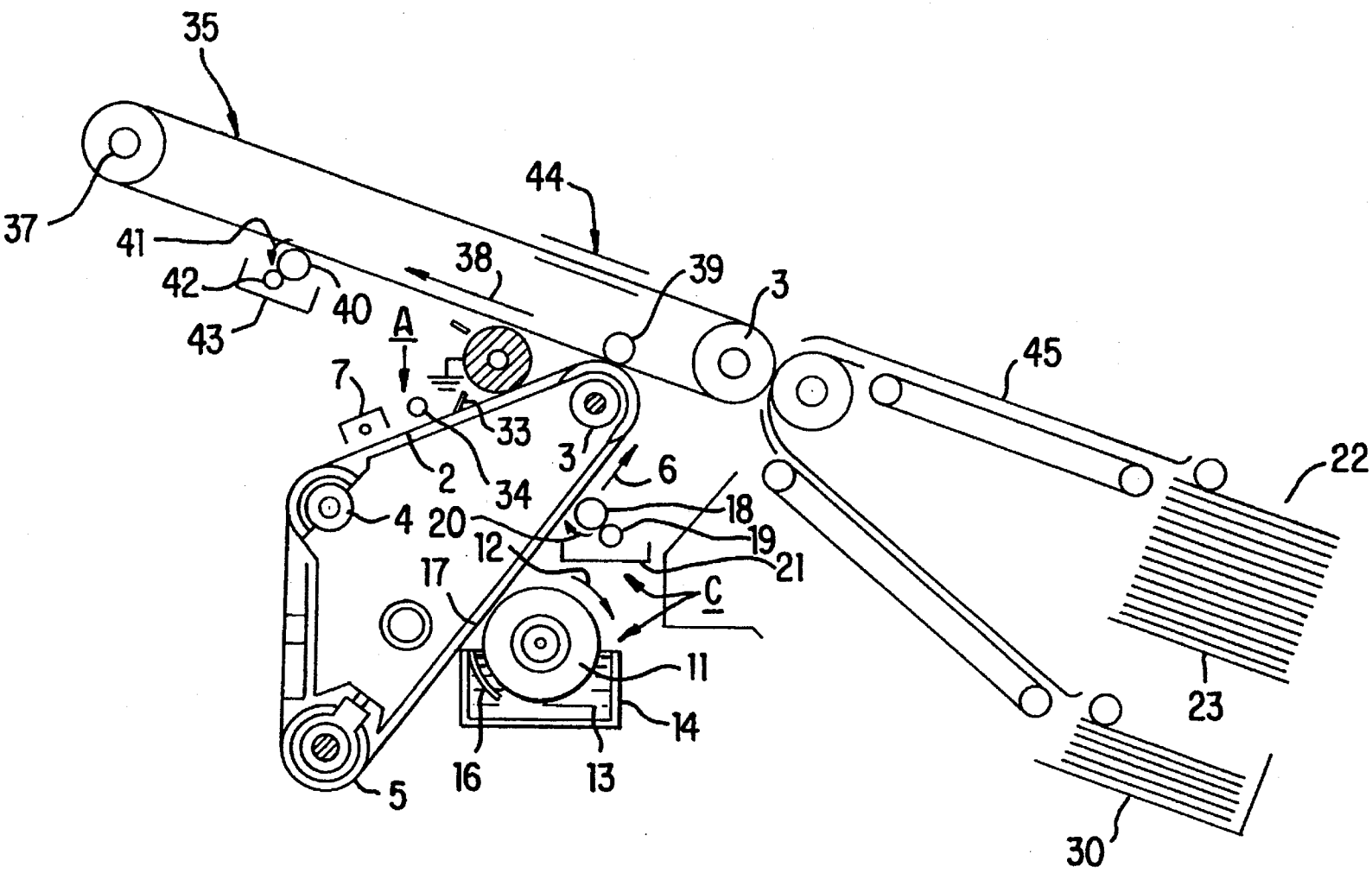
FIG. 2 is a schematic view depicting a portion of another electrostatographic printing machine.

FIG. 2 is a schematic representation of a portion of another electrostatographic printing machine. The printing machine of FIG. 2 employs a moving image carrying belt from which an image is transferred to an intermediate belt. Electrostatographic reproduction apparatus utilizing intermediate belts are exemplified by U.S. Pat. Nos. 4,183,658 to Winthaegen, 4,684,238 to Till et al., 4,690,539 to Radulski et al. and 5,119,140 to Berkes et al. In FIG. 2, elements that are identical to elements in FIG. 1 are identified with like reference numerals. Referring to FIG. 2, there is shown a printing machine 1 employing belt 2 having a photoconductive surface deposited on a conductive substrate. Three rollers 3, 4 and 5 located with parallel axes approximately at the apexes of a triangle provide the support assembly for the belt 2. Roller 3 rotates and advances belt 2 in the direction of arrow 6. Belt 2 passes through charging station A where a corona generating device 7 charges the photoconductive surface of the belt 2. The charge portion of belt 2 is advanced to exposure station B where image rays from an original document are projected by means of an optical system onto the charged portion of the photoconductive surface to record an electrostatic latent image. After the electrostatic latent image has been recorded, belt 2 advances to development station C. At station C, roller 11 advances a liquid developer material 13 from the chamber of housing 14 to development zone 15. Electrode 16 positioned before the entrance to development zone 17 is electrically biased so as to disperse the marking particles substantially uniformly throughout the liquid carrier. Development station C includes porous roller 18. Roller 18 receives the developed image on belt 2 and reduces fluid content on the image to provide an increase in percent solids. The roller 18 operates in conjunction with cleaner roller 19.

After the electrostatic latent image is developed, belt 2 advances the developed image to transfer station D. At transfer station D, the developed liquid image is electrostatically transferred to an intermediate member or belt indicated generally by the reference numeral 35. Belt 35 is entrained about spaced rollers 36 and 37. Belt 35 moves in the direction of arrow 38. Bias transfer roller 39 imposes belt 35 against belt 1 to assure image transfer to the intermediate belt 35. The porous roller 40 receives the developed image on belt 35 and further reduces fluid content on the image to provide an increase in percent solids. The roller increases percent solids to about 50 wt. % by removing excess hydrocarbon liquid in this region. Increasing solids on the intermediate belt is an important function in a color image developing process utilizing multiple images of different colors. As illustrated in FIG. 2, the roller of the invention may be used for controlling carrier liquid (and consequently percent particles) on an image on an intermediate belt thereby facilitating processes for color imagery.

In operation, roller 40 rotates in direction 41 to impose against the image on belt 35. The porous body of roller 40 absorbs liquid from the surface of the image. The liquid-containing portion of the porous roller 40 continues to rotate in direction 41 into contact with cleaning roller 42. Cleaning roller 42 presses against porous roller 40 and squeezes liquid from the roller 40 into liquid receptacle 43. Porous roller 40, discharged of excess liquid, continues to rotate in direction 41 to provide a continuous absorption of liquid from image on transfer belt 35.

Belt 35 then advances the developed image through radiant heater 44 then to transfer station D. At transfer station D, a sheet of support material 22 is advanced from stack 23 by sheet transport mechanism, indicated generally by the reference numeral 24. The developed image from the photoconductive surface of belt 35 is attracted to copysheet 22. After transfer, conveyor belt 45 moves the copysheet 22 to the discharge output tray 30.

Although the apparatus shown in FIG. 2 shows only a single porous roller 40, multiple porous roller stations can be utilized in accordance with the present invention in conjunction with the transfer of multiple images to intermediate belt 35.

Figure 3:
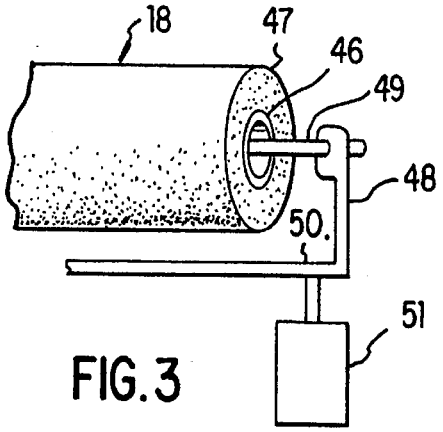
FIG. 3 is a schematic illustration of a roller according to the present invention.
Figure 4:
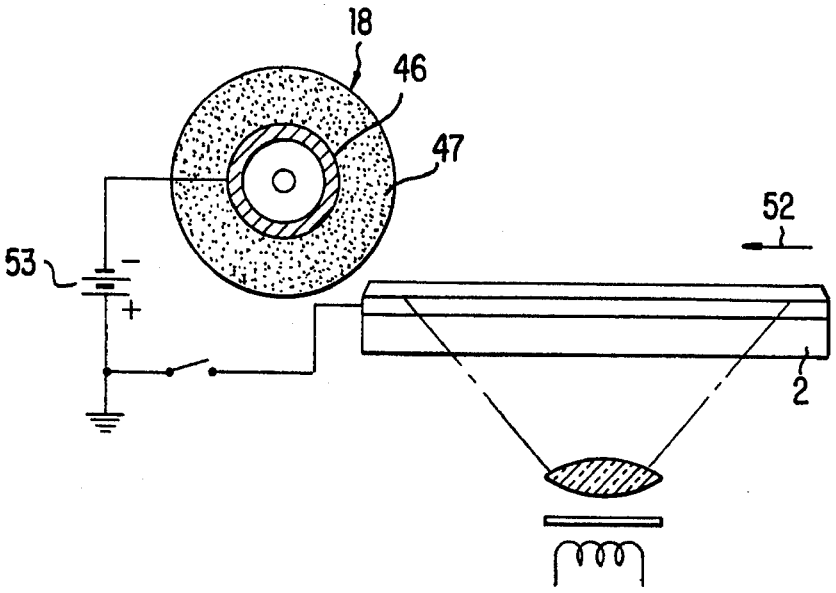
FIG. 4 is a schematic plan view of an embodiment of the roller and photoreceptor of the present invention.
Figure 5:
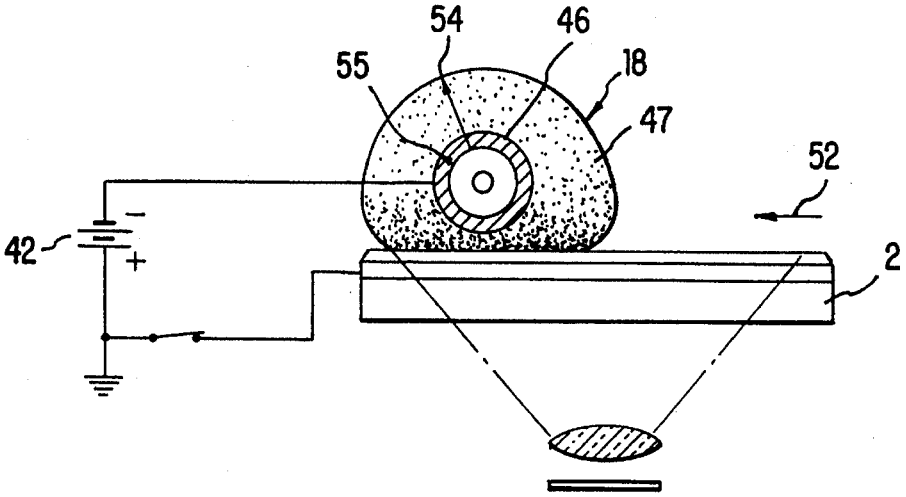
FIG. 5 is another schematic plan view of the embodiment of FIG. 1, showing the system in operation.

With reference to FIGS. 3, 4 and 5, there is shown a detailed structure of the roller 11 of development station C. The roller 11 comprises a rigid porous electroconductive supportive core 46. In this embodiment, the core 46 is in the form of a tube. A conformable microporous covering 47 is provided around the core 46. A pressure controller 48 is located to provide a positive or negative pressure within the porous core 46 and across the cross-section of the core 46 and covering 47.

The supportive core 46 can comprise a material selected from the group consisting of sintered metal, plastic and ceramic. In the instance the supportive core 46 comprises a sintered metal, exemplary metals include stainless steel, copper and bronze. In this embodiment, the supportive core 46 can be produced by filling a tube mold with metal particles, heating to bond the particles without complete coalescing and machining the tube to desired dimensions.

In the instance the core 46 comprises a plastic, the plastic can be impregnated with a conductive dopant or metal particles can be incorporated during formation. Alternatively, the plastic of the tube can be coated with metal after formation. The supportive core 46 can be a plastic tube coated reticulated with metal to form a complete conductive path from an inside surface to an outside surface. The plastic is selected from the group consisting of polyethylene, polypropylene, polyvinyl fluoride, polyvinylidene fluoride, ethylene vinyl acetate, polyester, polyamide, polysulfone and polytetrafluoro ethylene.

In the instance the supportive core 46 comprises a ceramic, the ceramic can be impregnated with a conductive dopant or impregnated with a metal film coating for conductivity. The ceramic can include a reduced metal oxide absorbed onto the surface of the supportive core 46. The ceramic supportive core 46 can be coated with a metallic conductive film throughout the porous core in the form of a reticulate. The metal oxide may be absorbed onto the surface of the ceramic supportive core 46 from solution and reduced in a heated hydrogen environment.

The conformable microporous resistive covering 47 is characterized by open cells forming the microporous covering. The covering 47 may be a polymeric and elastomeric foam material. The covering pores should be of a diameter of less than 100 μm. The conformable microporous resistive covering 47 can comprise a material selected from the group consisting of polyurethane, silicone polymer, polyester, polyethylene, polyether, polyvinylchloride, neoprene, polyimide, polyamide, porous polytetrafluoroethylene and fluoroelastomeric sponge. The polymeric and elastomeric material can contain a particulate filler material uniformly dispersed throughout the polymeric and elastomeric material. Suitable particulate filler materials include powdered carbon, carbon black and metal oxides. Suitable metal oxides include iron, lead, tin, antimony, barium, cobalt, copper, indium, nickel, titanium and their combinations. The conformable microporous resistive covering 47 has a thickness of 1.0 mils to 500 mils. Preferably the conformable microporous resistive covering 47 has a thickness of about 65 mils to 250 mils. The covering 47 may comprise a polymeric and elastomeric material with incorporated conductive filler or dissipative filler. Suitable fillers include quaternary ammonium salts and conductive polymers. The conformable micro-porous resistive covering 47 is characterized by a durometer of from 20 to 90 Shore. Preferably the durometer is from 40 to 60 Shore. The conformable microporous resistive covering 47 has a pore size of less than 100 μm. The pore size of the resistive covering 47 provides impedance to hydrocarbon liquid flow with capillary wetting sufficient to remove excess carrier liquid from the photoreceptor under a vacuum pressure of at least 4.0 inches of water while retaining hydrocarbon liquid within the pores of the covering 47. The foam material of the conformable micro-porous resistive covering can comprise a liquid self-sealing foam material.

Referring to FIG. 3, pressure controller 48 includes longitudinal axis pipe 49, support 50 and air pistons 51 (one shown). Air piston 51 applies the load for the compression of the porous covering 47. One piston 51 is located at each end of support roll 18. Pressure generated by piston 51 apply a pressure to the core of roller 18. The pressure is transmitted to the core by means of support 50 and pipe 49. Air pressure from 20 to 70 psi is employed to activate the piston 51 for loadings of 2 to 7 pounds. The piston load is engaged continuously during the development process and can be disengaged for cleaning when the machine operation is idle and for the removal of accumulated residual liquid developer material or unwanted material such as paper fibers, etc.

The porous roller 18 is shown normally uncompressed in FIG. 4 and operatively compressed in FIG. 5. It is compressively rotated by electroconductive core 46 against the image on belt 2 as belt 2 advances in direction 52. A high voltage bias supply 53 is connected between the belt 2 and the conductive core 46 for continuous prevention of transfer of development materials to porous covering 47. It may be seen in FIG. 5 that the porous covering 47 of the roller 18 is highly compressed from its normal uncompressed radius 54 into close to the radius 55 of the supportive core 46.

While the invention has been described with reference to particular preferred embodiments, the invention is not limited to the specific examples shown, and other embodiments and modifications can be made by those skilled in the art without departing from the spirit and scope of the invention and claims. For example, while the roller has been described for both applying toner and removing excess liquid from the photoreceptor, the roller could be provided in combination with a separate roller or rollers. Each roller would separately apply toner or remove excess liquid. The roller of the invention could be utilized to supply toner while the separate roller would remove excess liquid or the separate roller would supply toner and the roller of the invention would remove excess liquid.

What is claimed is:

1. A roller for controlling an application of carrier liquid to an image bearing member in an electrostatographic reproduction apparatus, comprising a rigid porous electroconductive supportive core, a conformable microporous covering provided around said core, and a pressure controller located to provide a positive or negative pressure within said porous core and across a cross-section of said core and covering.

2. The roller of claim 1, wherein said supportive core comprises a material selected from the group consisting of sintered metal, plastic and ceramic.

3. The roller of claim 2, wherein the supportive core is in the form of a tube.

4. The roller of claim 3, wherein the plastic is impregnated with a conductive dopant.

5. The roller of claim 4, wherein the supportive core is produced by incorporating metal particles into the plastic prior to formation of said tube or by coating the plastic of the tube with metal after formation.

6. The roller of claim 5, wherein the supportive core comprises a plastic tube coated with metal in the form of a completely conductive path from an inside surface to an outside surface of the tube.

7. The roller of claim 2, wherein the plastic is selected from the group consisting of polyethylene, polypropylene, polyvinyl fluoride, polyvinylidene fluoride, ethylene vinyl acetate, polyester, polyamide, polysulfone and polytetrafluoro ethylene.

8. The roller of claim 3, wherein the ceramic is impregnated with a conductive dopant.

9. The roller of claim 3, wherein the ceramic is impregnated with a metal film coating.

10. The roller of claim 3, wherein the ceramic comprises a reduced metal oxide absorbed onto the surface of said supportive core.

11. The roller of claim 10, comprising a porous ceramic supportive core coated with a metallic, conductive film throughout said porous core in the form of a reticulate.

12. The roller of claim 10, wherein the metal oxide is absorbed onto the surface of the ceramic supportive core from solution and is reduced in a heated hydrogen environment.

13. The roller of claim 3, wherein the sintered metal is selected from the group consisting of stainless steel, copper and bronze.

14. The roller of claim 3, wherein the supportive core is in the form of a micro-porous tube.

15. The roller of claim 3, wherein the supportive core is produced by filling a tube mold with metal particles, heating to bond the particles without complete coalescing and machining the tube to desired dimensions.

16. The roller of claim 1, wherein the conformable microporous covering is characterized by open cells forming said microporous covering.

17. The roller of claim 1, wherein the covering is a polymeric and elastomeric foam material.

18. The roller of claim 17, wherein said covering is characterized by a pores of a diameter of less than 100 μm.

19. The roller of claim 1, wherein the conformable microporous covering comprises a material selected from the group consisting of polyurethane, silicone polymer, polyester, polyethylene, polyether, polyvinylchloride, neoprene and polyamide.

20. The roller of claim 1, wherein the conformable microporous covering is compounded with particulate filler material.

21. The roller of claim 20, wherein the particulate filler material is selected from the group consisting of powdered carbon, carbon black and metal oxide.

22. The roller of claim 21, wherein the metal oxide is selected from the group consisting of iron, lead, tin, antimony, barium, cobalt, copper, indium, nickel and titanium and their combinations.

23. The roller of claim 17, comprising a polymeric and elastomeric material containing a particulate filler material uniformly dispersed throughout said polymeric and elastomeric material.

24. The roller of claim 17, wherein said covering comprises a polymeric and elastomeric material with incorporated conductive filler or dissipative filler.

25. The roller of claim 17, wherein said covering comprises a polymeric and elastomeric material with incorporated quaternary ammonium salt filler or conductive polymer filler.

26. The roller of claim 1, wherein said conformable microporous covering has a thickness of 1.0 mils to 500 mils.

27. The roller of claim 1, wherein said conformable microporous covering has a thickness of 65 mils to 250 mils.

28. The roller of claim 1, wherein said conformable microporous resistive covering is characterized by a durometer of from 20 to 90 Shore.

29. The roller of claim 1, wherein said conformable microporous covering is characterized by a durometer of from 40 to 60 Shore.

30. The roller of claim 1, wherein said conformable microporous covering is characterized by a pore size of less than 100 μm.

31. The roller of claim 1, wherein said conformable microporous covering is characterized by a pore size providing low impedance to hydrocarbon liquid flow with capillary wetting sufficient to remove excess carrier liquid from said image bearing member under a vacuum pressure of at least 4.0 inches of water while retaining hydrocarbon liquid within the pores of said covering.

32. The roller of claim 1, wherein said conformable microporous covering comprises a self sealing foam material.

33. The roller of claim 1, wherein said image bearing member is a photoreceptor.

34. The roller of claim 1, wherein said image bearing member is an intermediate or transfix belt.

35. An electrostatographic reproduction apparatus comprising an image bearing member and a roller for controlling an application of carrier liquid to said member, comprising a rigid porous electroconductive supportive core, a conformable microporous covering provided around said core, and a pressure controller located to provide a positive or negative pressure within said porous core and across a cross-section of said core and covering while in contact with said image bearing member.

36. The electrostatic reproduction apparatus of claim 35, wherein said supportive core comprises a material selected from the group consisting of sintered metal, plastic and ceramic.

37. The electrostatic reproduction apparatus of claim 35, wherein the conformable microporous covering is characterized by open cells forming said microporous covering.

38. The electrostatic reproduction apparatus of claim 35, wherein the covering is a polymeric and elastomeric foam material.

39. The electrostatic reproduction apparatus of claim 35, wherein the conformable microporous covering comprises a material selected from the group consisting of polyurethane, silicone polymer, polyester, polyethylene, polyether, polyvinylchloride, neoprene, polyimide, polyamide, porous polytetrafluoroethylene and fluoroelastomeric sponge.

40. The electrostatic reproduction apparatus of claim 35, wherein said conformable micro-porous covering is characterized by a pore size providing low impedance to hydrocarbon liquid flow with capillary wetting sufficient to remove excess carrier liquid from said photoreceptor under a vacuum pressure of at least 4.0 inches of water while retaining hydrocarbon liquid within the pores of said covering.

41. The electrostatic reproduction apparatus of claim 35, wherein said image bearing member is a photoreceptor.

42. The electrostatic reproduction apparatus of claim 35, wherein said image bearing member is an intermediate or transfix belt.

43. An electrostatographic process comprising forming a latent electrostatic image on a moving imaging surface, developing the latent image with liquid developer and removing excess liquid from said imaging surface by contacting the surface with the roller of claim 1, controlling the application of liquid toner and removing excess carrier liquid on said imaging surface by applying a pressure gradient from within the core of said roller.

44. The process of claim 43 comprising removing excess carrier liquid from said imaging surface under a vacuum pressure of at least 4.0 inches of water.

45. The process of claim 43, comprising transferring the developed image to a support material.

46. The process of claim 45, comprising fusing said image to said support material.

47. The process of claim 43, comprising transferring the developed image to an image bearing member.

48. The process of claim 47, wherein said image bearing member is an intermediate or transfix belt.

49. The roller of claim 1, further including a high voltage bias supply coupled to said electroconductive supportive core.

50. The electrostatographic reproduction apparatus of claim 35, further including a high voltage bias supply connected between the image bearing member and the roller for prevention of transfer of developing materials to the microporous covering.

51. The electrostatographic process of claim 43, comprising applying a high voltage bias to said roller for preventing transfer of developing materials thereto.

* * * * *